US006478037B2

(12) United States Patent
Tung

(10) Patent No.: US 6,478,037 B2
(45) Date of Patent: Nov. 12, 2002

(54) FOLDABLE SUNSHADE WITH A TILTABLE CANOPY

(76) Inventor: Pai Tung, No. 2, Cheng Shing Road, San Min, Kaohsiung (TW)

( * ) Notice: Subject to any disclaimer, the term of this patent is extended or adjusted under 35 U.S.C. 154(b) by 0 days.

(21) Appl. No.: 09/753,469

(22) Filed: Jan. 3, 2001

(65) Prior Publication Data

US 2002/0083969 A1 Jul. 4, 2002

(51) Int. Cl.[7] ..... A45B 11/00
(52) U.S. Cl. ..... 135/21; 135/20.1
(58) Field of Search ..... 135/25.1, 15.1, 135/90, 29, 96, 21, 98, 20, 20.1, 31–32, 38–39, 21.3

(56) References Cited

U.S. PATENT DOCUMENTS 5,387,048 A * 2/1995 Kuo ..... 135/25.1
6,105,594 A * 8/2000 Diaz ..... 135/16
6,152,156 A * 11/2000 Tung ..... 135/21
6,220,261 B1 * 4/2001 Glatz ..... 135/20.3
6,244,286 B1 * 6/2001 Russo ..... 135/128

* cited by examiner

*Primary Examiner*—Beth A. Stephan
(74) *Attorney, Agent, or Firm*—Alan D. Kamrath; Rider, Bennett, Egan & Arundel

(57) ABSTRACT

A sunshade includes a supporting rod, a canopy support frame, and a canopy. An adjusting sleeve is slidably mounted around the supporting rod. A holding sleeve is pivotally connected to an upper end of the supporting rod. An arcuate tube is slidably extended through the holding sleeve. An elbow is mounted to a first end of the arcuate tube and a reel is mounted to a second end of the arcuate tube. A connecting rod is connected between the second end of the arcuate tube and the adjusting sleeve. An anchor is provided to be releasably engaged in an anchor room in the elbow to reliably retain the canopy support frame in a desired tilting angle relative to the supporting rod. The arcuate tube and the supporting rod can be folded to further reduce the overall volume of the sunshade.

20 Claims, 13 Drawing Sheets

FOLDABLE SUNSHADE WITH A TILTABLE CANOPY

BACKGROUND OF THE INVENTION

1. Field of the Invention

The present invention relates to a foldable sunshade with a tiltable canopy.

2. Description of the Related Art

A sunshade may provide a comfortable space for outdoor activities. A so-called free-arm sunshade manufactured by Glatz Ltd. includes a main frame, a canopy support frame, and a canopy. Although the canopy support frame of the free-arm sunshade is tiltable (rotatable) in all directions to obtain optimum shade, it is, however, found that the adjustment is troublesome. More specifically, the user has to lower the canopy to a reachable level (otherwise a chair or the like is required to reach the canopy), rotate the canopy, and raise the canopy again. The user must operate the mechanism for adjusting the height of the canopy twice. In addition, the device allowing rotation of the canopy in all directions is complicated and might be actuated by strong wind. Furthermore, the volume of the sunshade is relatively large and thus inconvenient and costly to transport. U.S. Pat. No. 6,152,156 issued to Tung (the Applicant) on Nov. 28, 2000 discloses an improved sunshade that allows easy operation in adjusting the tilting angle of the canopy. The present invention is intended to provide an improved design to allow further folding of the sunshade to reduce the volume for transport.

SUMMARY OF THE INVENTION

It is a primary object of the present invention to provide an improved sunshade in which the canopy is tiltable, and adjustment of the tilting angle of the canopy can be easily achieved.

It is another object of the present invention to provide an improved sunshade in which the canopy can be reliably retained in a desired tilting angle.

It is a further object of the present invention to provide an improved sunshade that is foldable. In addition, the canopy support frame together with the canopy can be disengaged from the elbow when not in use.

A sunshade in accordance with the present invention comprises:

a supporting rod having a lower end and an upper end;

an adjusting sleeve slidably mounted around the supporting rod;

a holding sleeve pivotally connected to the upper end of the supporting rod;

an arcuate tube slidably extended through the holding sleeve and including a first end and a second end;

an elbow connected to the first end of the arcuate tube and including an anchor room;

an anchor releasably engaged in the anchor room;

a canopy support frame for supporting a canopy and including a suspension member connected to the elbow, an upper support base having a plurality of ribs attached thereto for supporting a canopy, and a lower support base having a plurality of stretchers attached thereto for supporting the ribs, the lower support base being connected to the anchor;

a reel mounted to the second end of the arcuate tube and including a handle;

a cable having a first end connected to the handle and a second end connected to the anchor, the cable being movable in a retracting direction and a releasing direction;

a connecting rod connected between the second end of the arcuate tube and the adjusting sleeve;

wherein when the handle is operated to release the cable in the releasing direction, the is anchor is disengaged from the anchor room of the elbow while the canopy is folded, and when the handle is operated to retract the cable in the retracting direction, the anchor is moved into the anchor room and thus engages the suspension member with the elbow when the canopy is in a fully opened status;

wherein the adjusting sleeve is slidable along the supporting rod while the arcuate tube is slidable along the holding sleeve to adjust a tilting angle of the canopy relative to the supporting rod;

wherein the arcuate tube includes at least two telescopic tube sections to allow adjustment of an overall length of the arcuate tube; and wherein the support rod includes at least two telescopic tube sections to allow adjustment of an overall length of the support rod.

The arcuate tube includes a control sleeve to restrain sliding movement of the arcuate tube relative to the holding sleeve. The control sleeve bears against the holding sleeve when the canopy is in an upright position. In an embodiment of the invention, the arcuate tube includes an outer tube section having a first end to which the reel is attached and an inner tube section having a first end telescopically received in a second end of the outer tube section and a second end to which the elbow is attached. The control sleeve is mounted to the second end of the outer tube section and includes a hole aligned with a transverse hole of the outer tube section. An elastic element has a first end securely attached to an inner periphery of the inner tube section and a second end to which a push button is attached. When the arcuate tube is in an extended status, the push button is extended through the transverse hole of the outer tube section and the hole of the control sleeve. When the push button is pushed inward and a longitudinal force is applied to the inner tube section in a retracting direction, the inner tube section is retracted into the outer tube section. When a longitudinal force is applied to the inner tube in a releasing direction, the inner tube section is pulled out of the outer tube section and the push button is extended into the transverse hole of the outer tube section and the hole of the control sleeve under the action of the elastic element when the push button reaches the level of the transverse hole of the outer tube section and the hole of the control sleeve.

The first end of the inner tube section includes an end cap securely attached thereto. The end cap includes a flange in sliding contact with an inner periphery of the outer tube section. A stop is securely mounted around the inner tube section. The stop bears against an end face of the control sleeve for preventing disengagement of the push button when the arcuate tube is in its fully extended status. The stop and the flange assure stable sliding movement of the inner tube section relative to the outer tube section.

The supporting rod includes a lower tube section and an upper tube section which are identical to the arrangements of the inner tube section and the outer tube section of the arcuate tube, thereby allowing adjustment in the overall length of the supporting rod.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
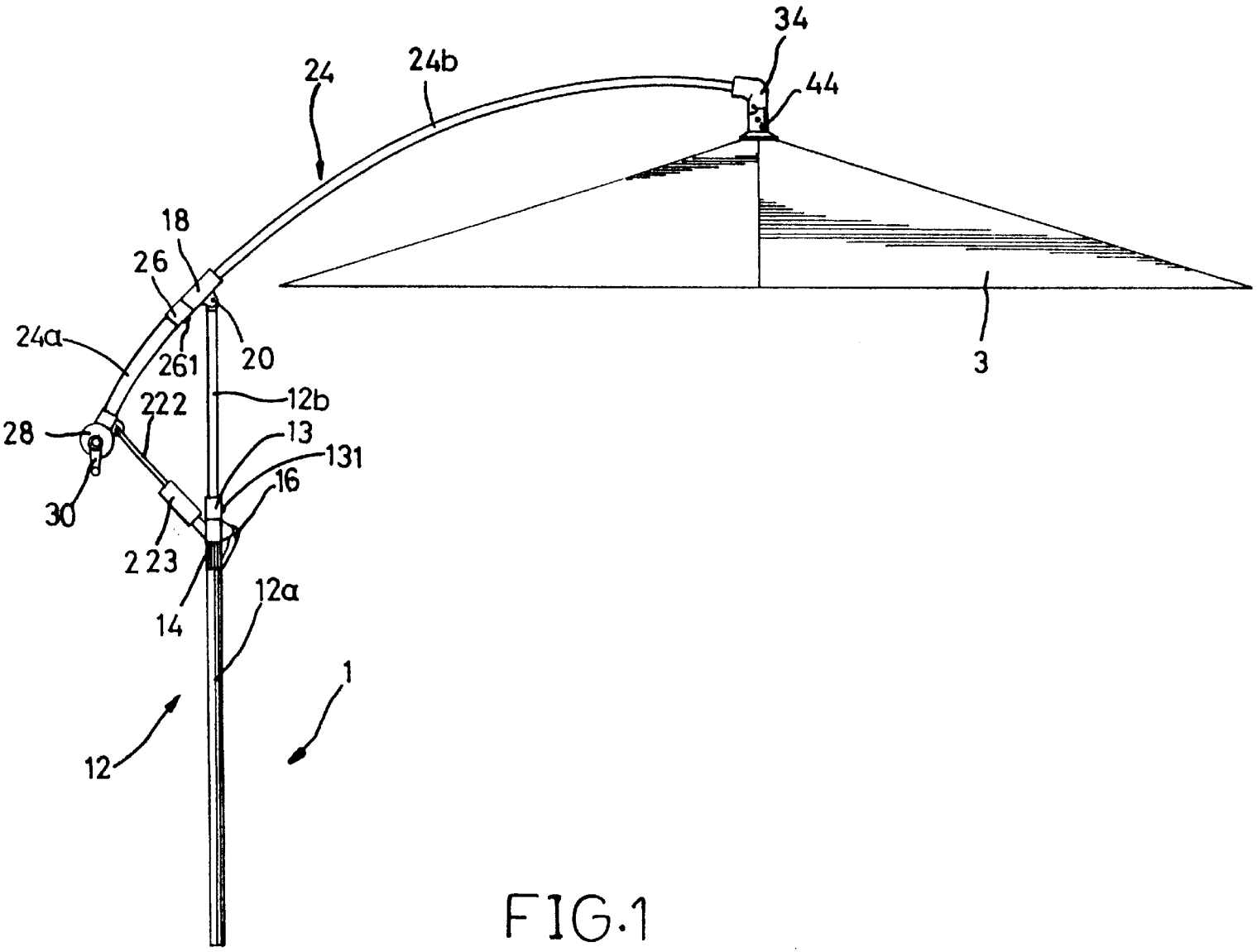
FIG. 1 is a perspective view of a sunshade in accordance with the present invention.

Referring to the drawings and initially to FIG. 1, a sunshade in accordance with the present invention generally includes a main frame 1, a canopy support frame 2 (FIG. 3), and a canopy 3. The main frame 1 includes a supporting rod 12, an adjusting sleeve 14 slidably mounted around the supporting rod 12, and a lever 16 mounted to the adjusting sleeve 14. When the lever 16 is in a locked position, the adjusting sleeve 14 is frictionally retained in place, and when the lever 16 is in a released position, sliding movement of the adjusting sleeve 14 relative to the supporting rod 12 is allowed.

The supporting rod 12 includes at least two tube sections. In this embodiment, the supporting 12 includes a lower tube section 12*a* and an upper tube section 12*b* having a lower end telescopically received in the lower tube section 12*a*. A control sleeve 13 is mounted to an upper end of the lower tube section 12*a* for retaining the upper tube section 12*b* and the lower tube section 12*a* in place or allowing telescopic movement of the upper tube section 12*a* relative to the lower tube section 12*a*, which will be described later. A holding sleeve 18 is pivotally connected to an upper end of the upper tube section 12*b* at 20. An arcuate tube 24 is provided and includes at least two tube sections. In this embodiment, the arcuate tube 24 includes an outer tube section 24*a* and an inner tube section 24*b* having an end telescopically received in the outer tube section 24*a*. The outer tube section 24*a* is slidably extended through the holding sleeve 18. A control sleeve 26 is mounted to an end of the outer tube section 24*a* for retaining the inner tube section 24*b* and the outer tube section 24*a* in place or allowing telescopic movement of the inner tube section 24*b* relative to the outer tube section 24*a*, which will be described later. An elbow 34 mounted to the other end of the inner tube section 24*b* and a reel 28 is mounted to an end of the outer tube section 24*a*. The reel 28 includes a handle 30 for manual operation for folding or unfolding the canopy 3, which will be described later.

Figure 2:
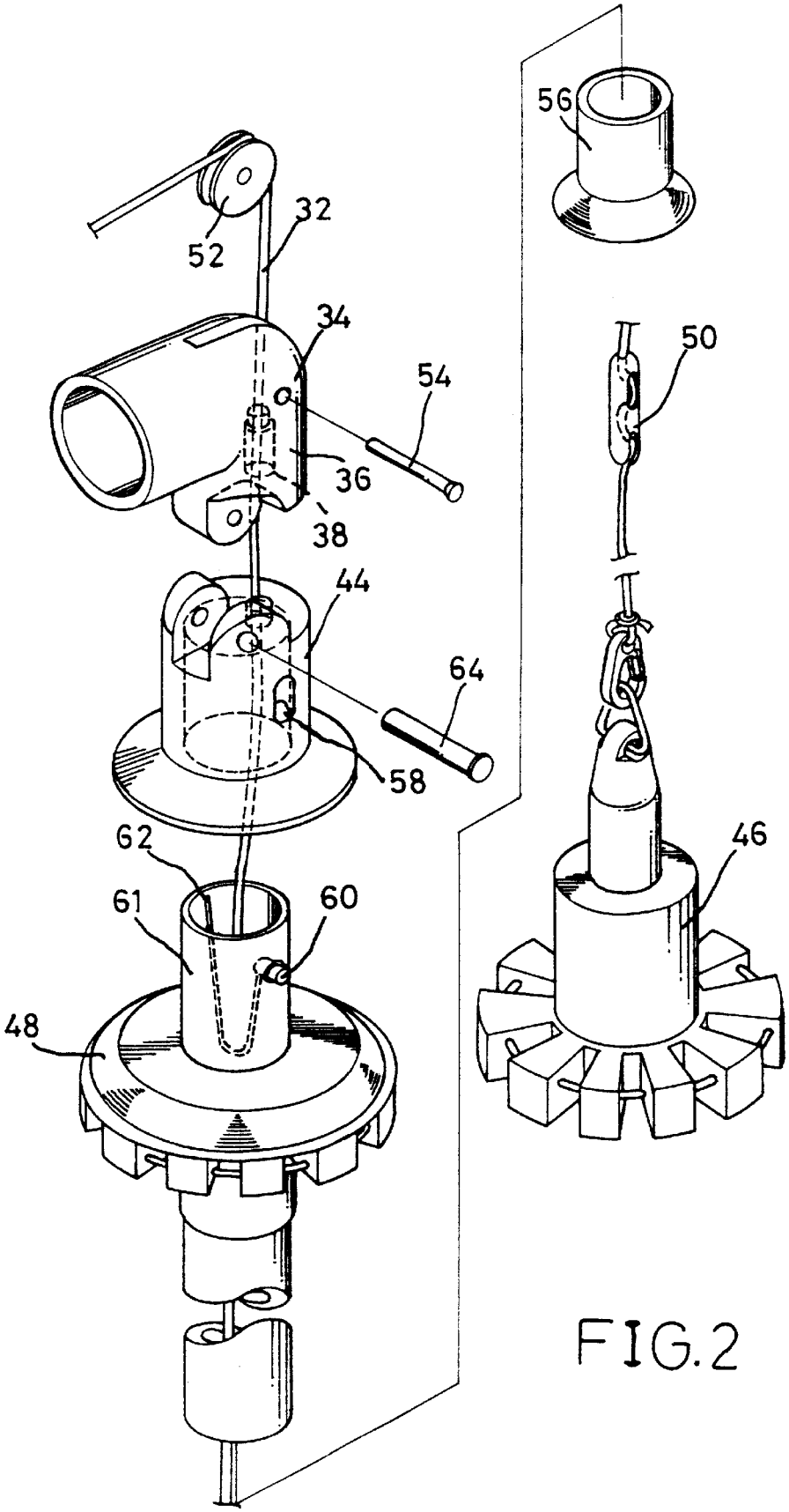
FIG. 2 is an exploded perspective view of a canopy support frame of the sunshade.
Figure 3:
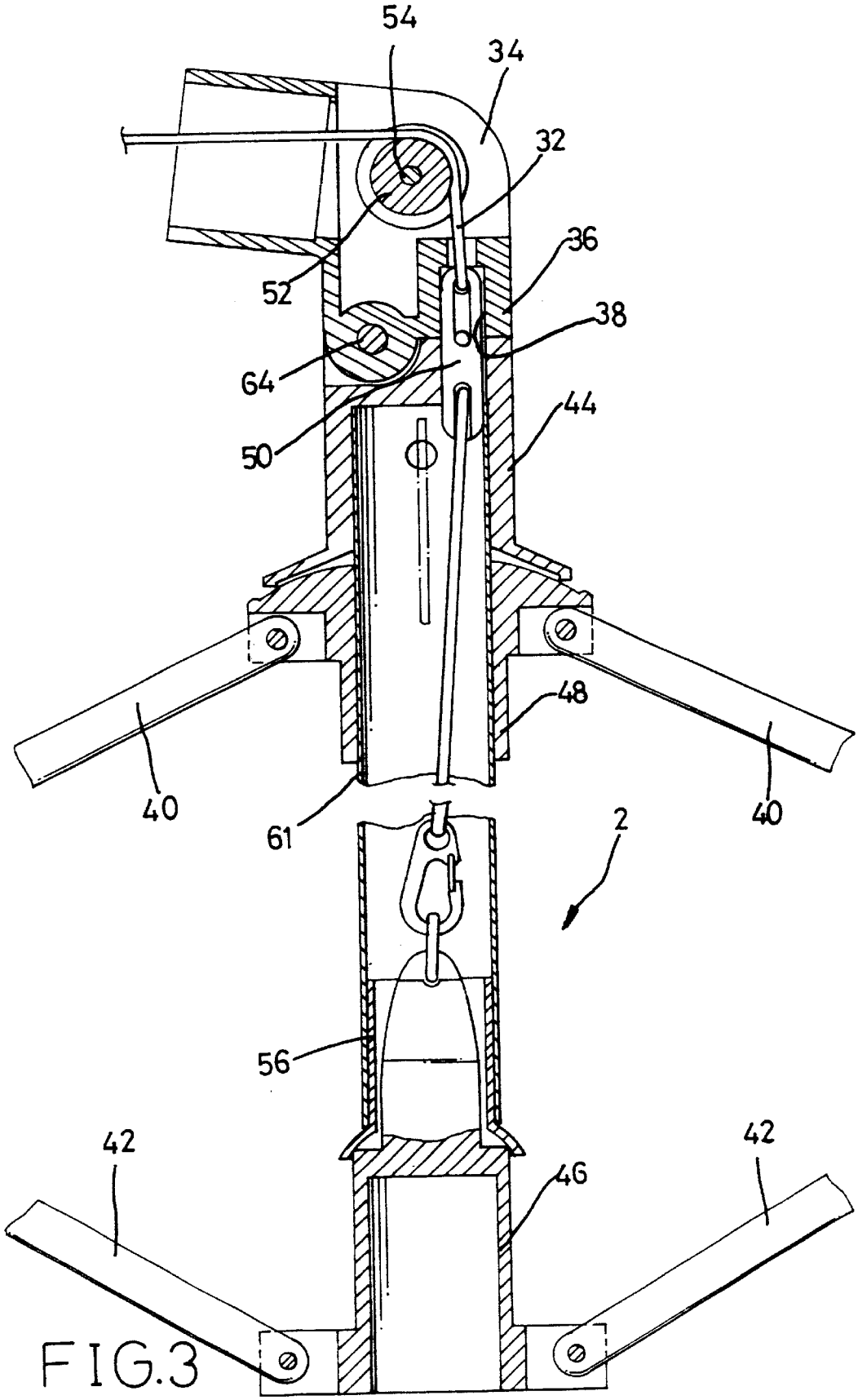
FIG. 3 is a partial sectional view of the sunshade, wherein the canopy support frame is in a fully extended status.

Referring to FIGS. 2 and 3, the canopy support frame 2 includes a suspension member 44, an upper support base 48 having a number of ribs 40 attached thereto for supporting the canopy 3, and a lower support base 46 having a number of stretchers 42 attached thereto for supporting the ribs 40. The elbow 34 includes a horizontal section (not labeled) and a vertical section 36 having an anchor room 38 defined therein. A cable 32 includes a first end attached to and operable by the handle 30 of the reel 28 so as to be movable in a retracting direction and a releasing direction. A second end of the cable 32 is secured to an anchor 50 after being wound through a pulley 52, which, in turn, is freely rotatably mounted in the elbow 34 by a pin 54. The suspension member 44 is connected to the vertical section 36 of the elbow 34 by a pin 64. The upper support base 48 is releasably engaged with the suspension member 44. In this embodiment, the upper support base 48 includes a tube 61 having a button 60 mounted to an upper end thereof and biased outwardly by an elastic member 62. A support sleeve 56 is mounted on top of the lower support base 46 and a lower end of the tube 61 is mounted around the support sleeve 56. The suspension member 44 includes a transverse hole 58 defined in a periphery thereof. In assembly, the tube 61 is inserted into the suspension member 44, and the button 60 is depressed by an inner wall of the suspension member 44 until the button 60 reaches the transverse hole 58 and extended outwardly under the action of the elastic member 62, thereby providing a secure engagement between the suspension member 44 and the tube 61. Detachment of the suspension member 44 and the tube 61 can be easily achieved by pushing the button 60 and pulling the tube 61 downwardly. The lower support base 46 includes an upper end securely connected to the anchor 50 by any suitable means.

Figure 4:
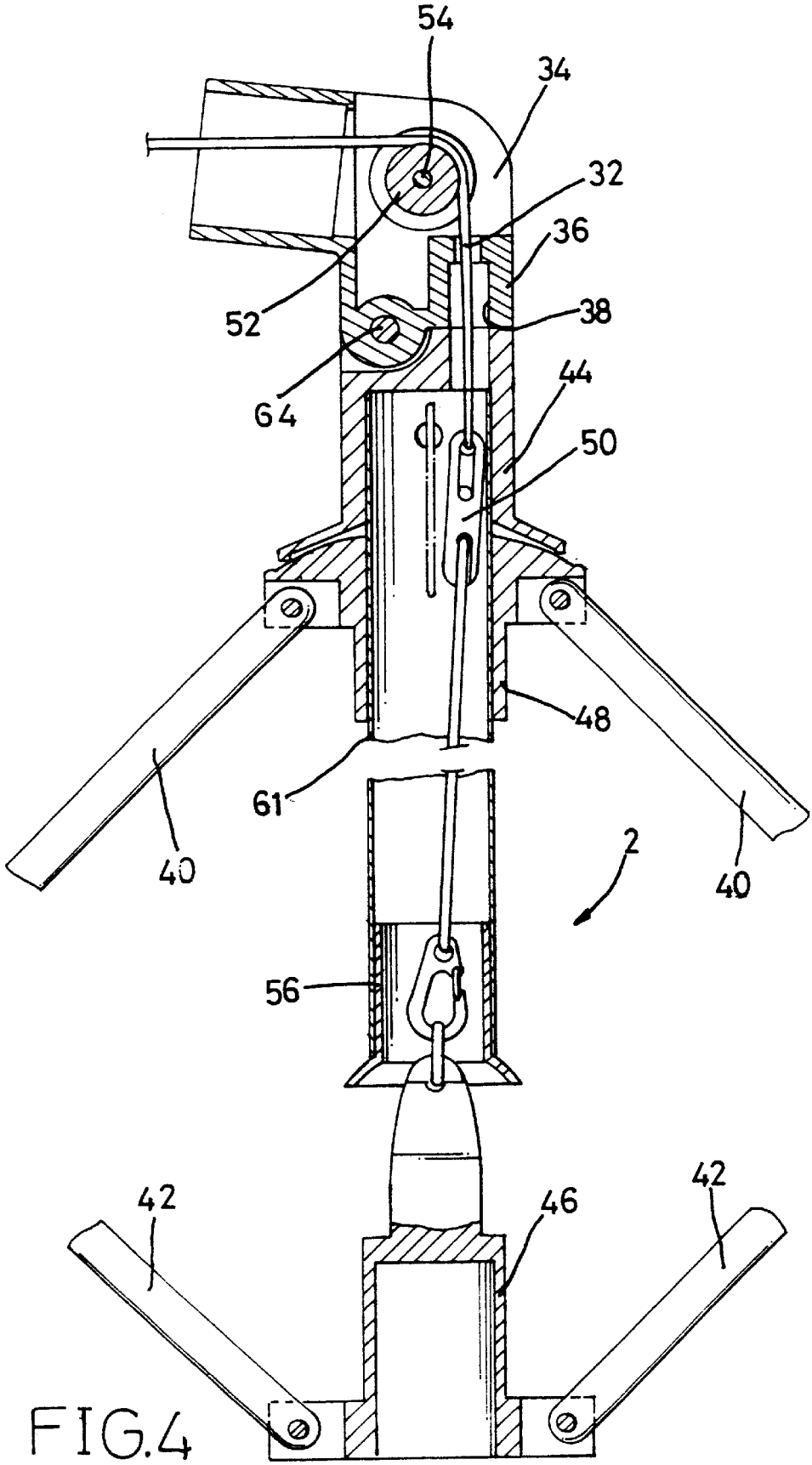
FIG. 4 is a view similar to FIG. 3, illustrating a folding operation of the canopy support frame.
Figure 9:
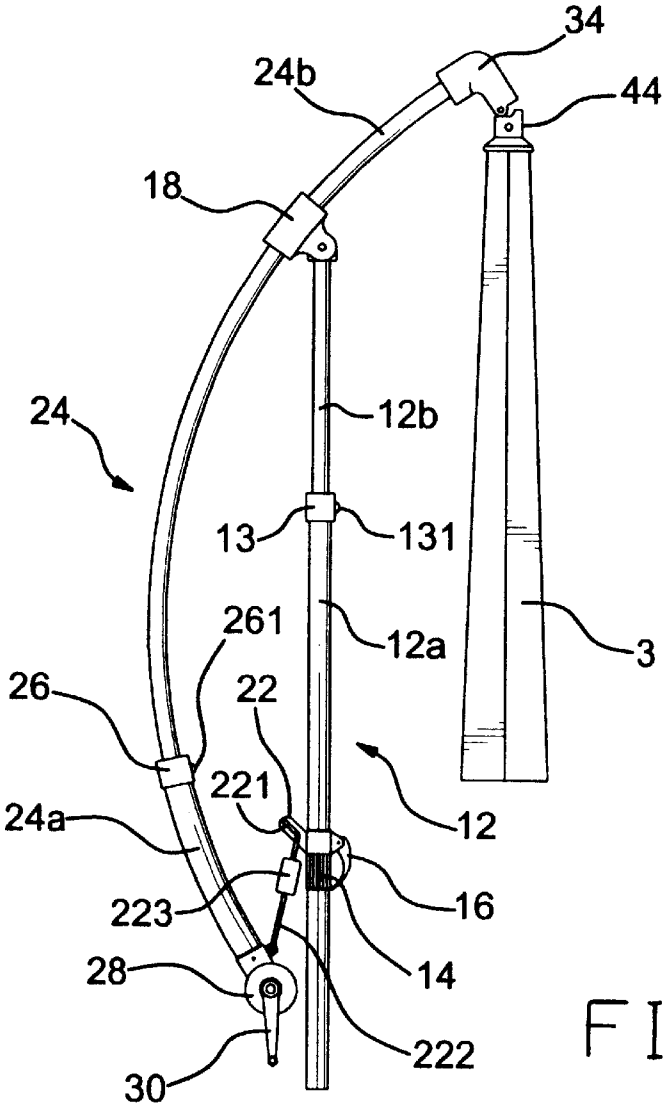
FIG. 9 is a side view of the sunshade in a folded status.

The canopy 3 of the sunshade in FIG. 1 is in a fully opened status. When not in use, the user may operate the handle 30 to move the cable 32 in the releasing direction to thereby lower the anchor 50 such that the anchor 50 disengages from the anchor room 38 of the elbow 34 (FIG. 4), and the canopy 3 collapses (FIG. 9). The user may operate the handle 30 to move the cable 32 in the retracting direction to raise the anchor 50 until the anchor 50 enters and is thus anchored in the anchor room 38, best shown in FIG. 3. The anchor 50 securely engages the elbow 34 with the suspension member 44, the purpose of which will be described later.

Figure 5:
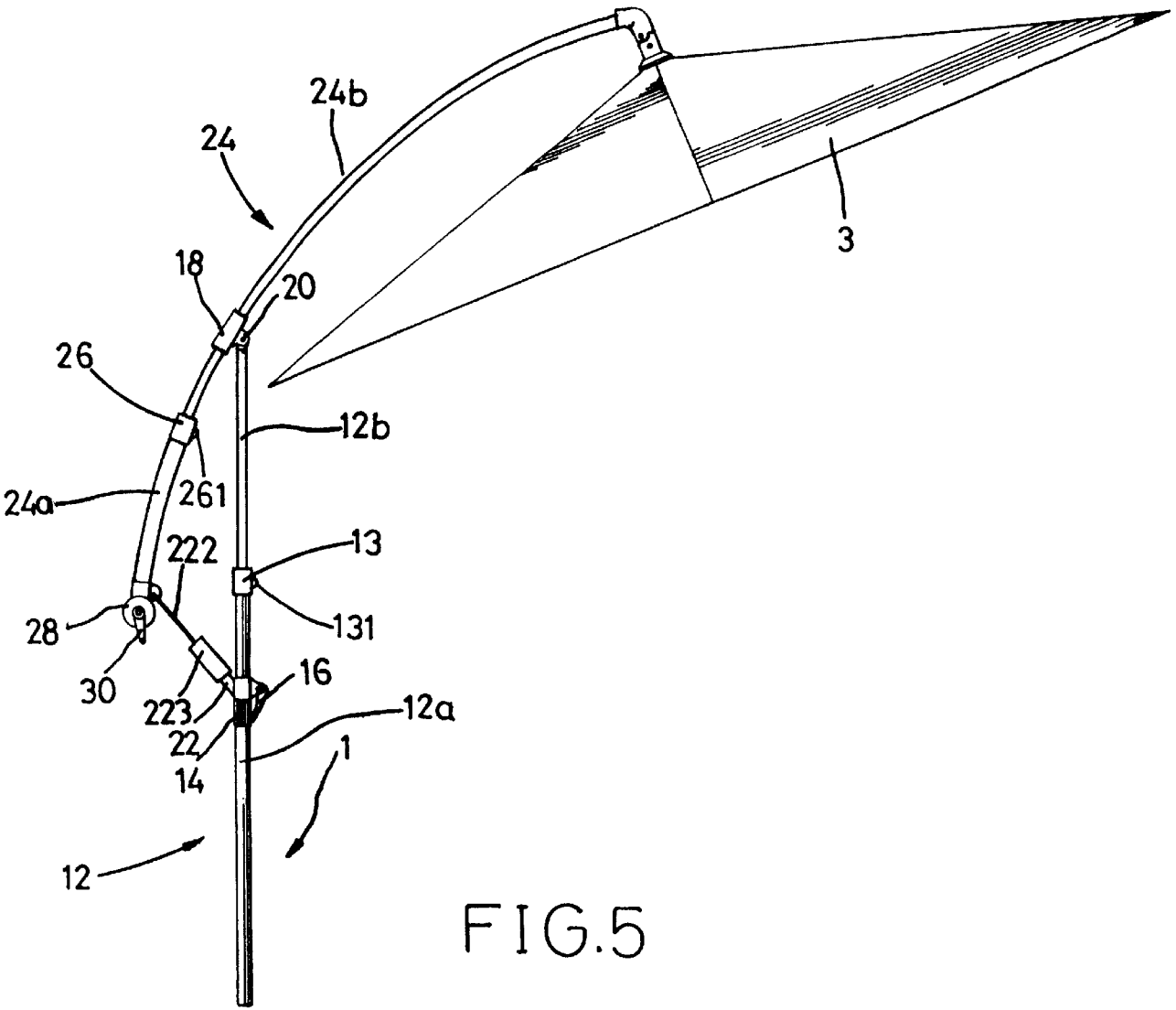
FIG. 5 is a side view illustrating tilting of the canopy.

The canopy of the sunshade in FIG. 1 is in an upright, non-tilting position. The control sleeve 26 on the arcuate tube 24 serves as a stop for restraining the position of the arcuate tube 24. As shown in FIG. 1, the control sleeve 26 bears against the holding sleeve 18 when the canopy 3 is in the upright position. Referring to FIG. 5, when adjustment of the tilting angle of the canopy 3 is required, the lever 16 is released to allow the adjusting sleeve 14 to move downwardly along the supporting rod 12. The arcuate tube 24 (including the outer tube section 24*a* and the inner tube section 24*b*) is slid along the holding sleeve 18 until a desired tilting angle of the canopy 3 is reached for optimum shade. The lever 16 is then switched to its locked position. The pivotal connection between the holding sleeve 18 and the supporting rod 12 assists in smooth sliding movement of the whole arcuate tube 24 relative to the holding sleeve 18. Of more importance, the anchor 50 securely engages the suspension member 44 with the elbow 34 such that the canopy 3 can be reliably retained in a desired tilting angle relative to the vertical axis of the supporting rod 12.

Figure 6:
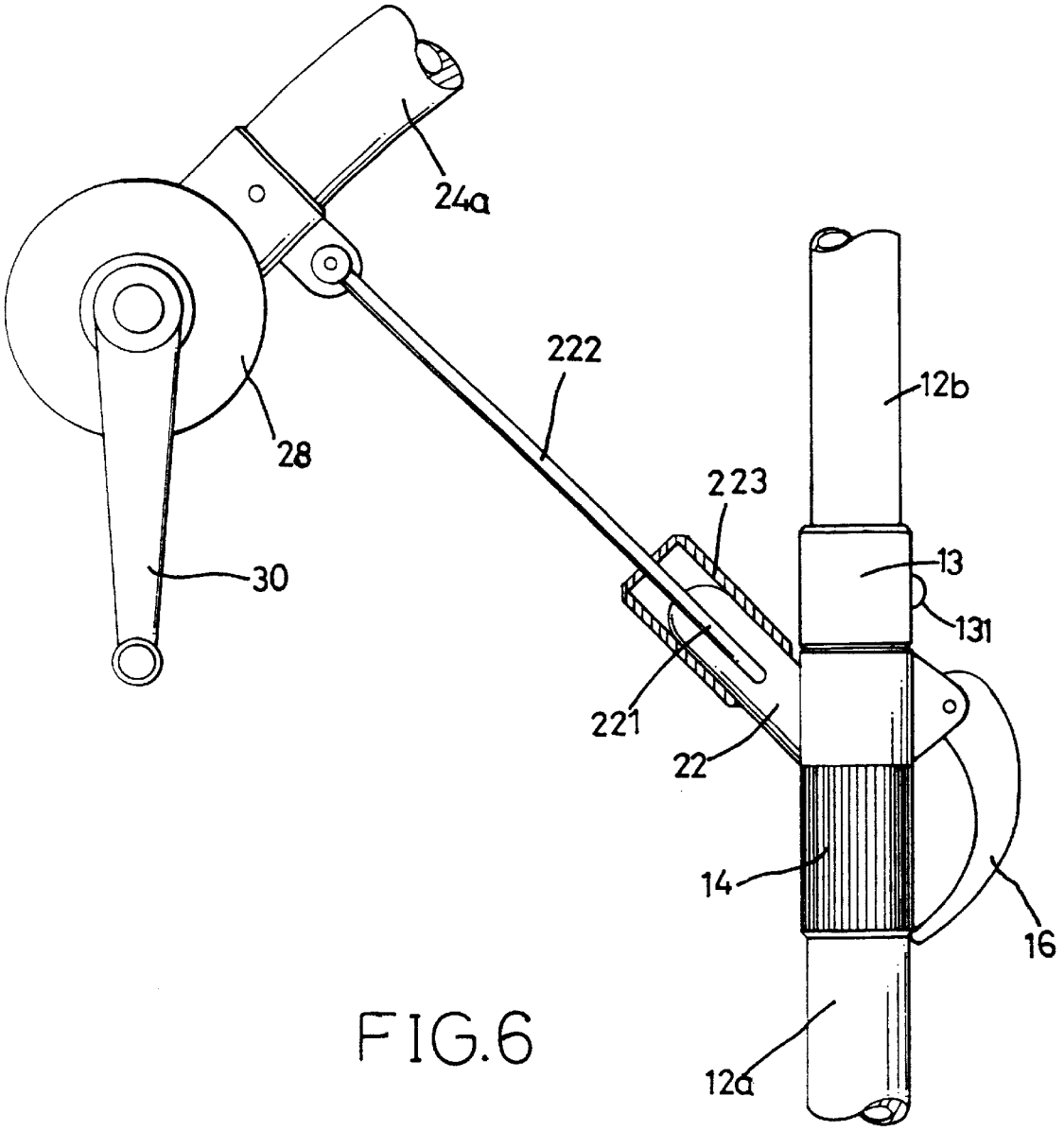
FIG. 6 is a partially sectioned side view of a portion of a main frame of the sunshade.
Figure 7:
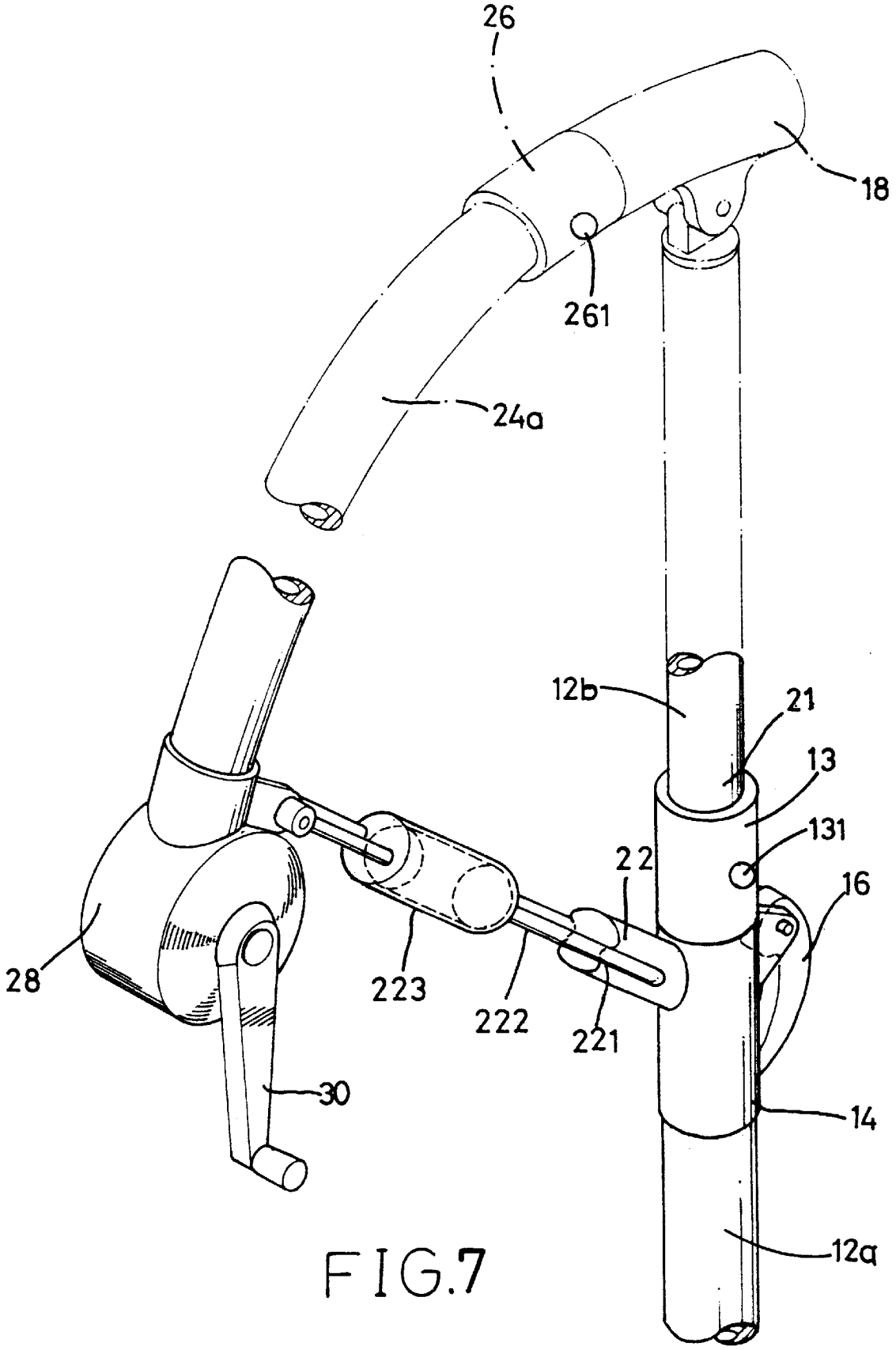
FIG. 7 is a partial perspective view illustrating a folding operation of the main frame.
Figure 8:
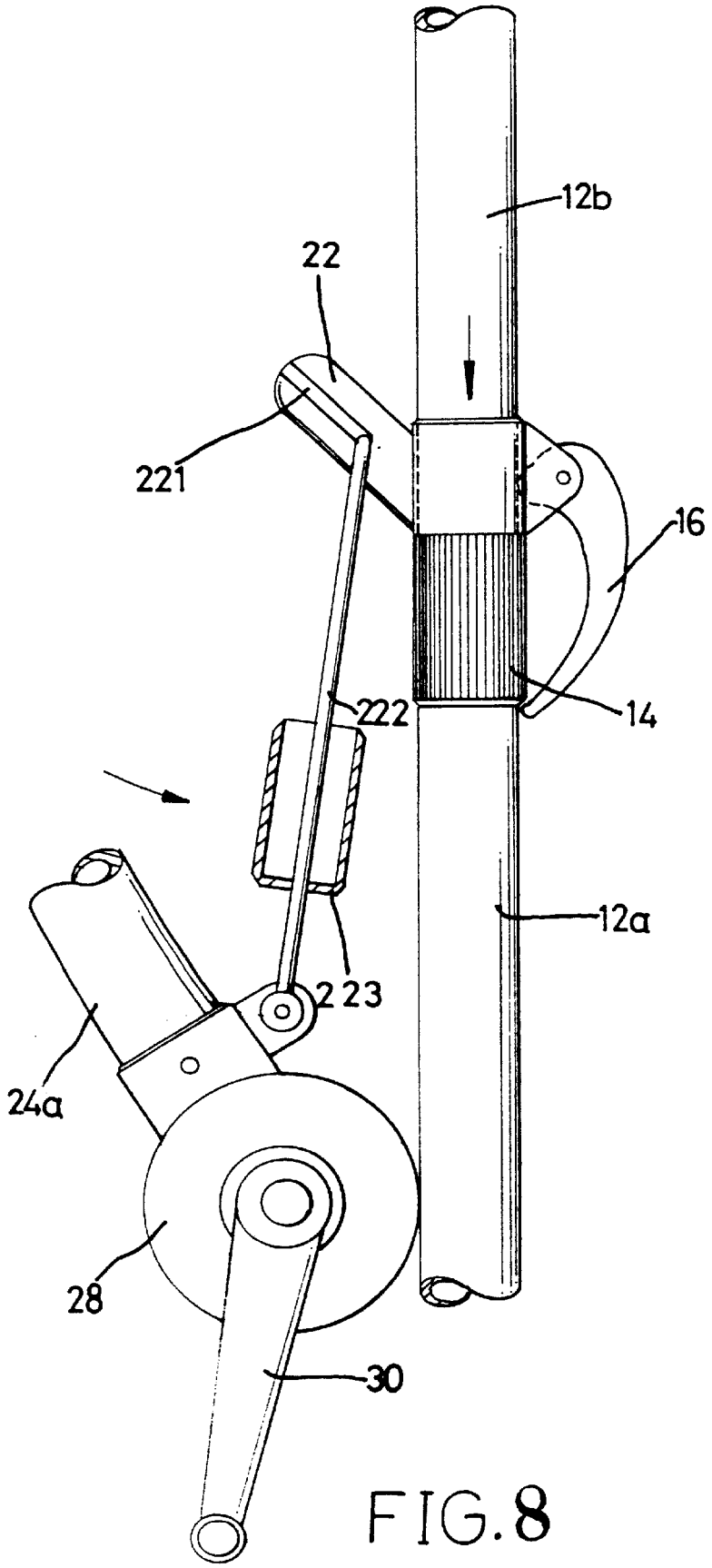
FIG. 8 is a partially sectioned side view of the portion of the main frame in a folded status.
Figure 10:
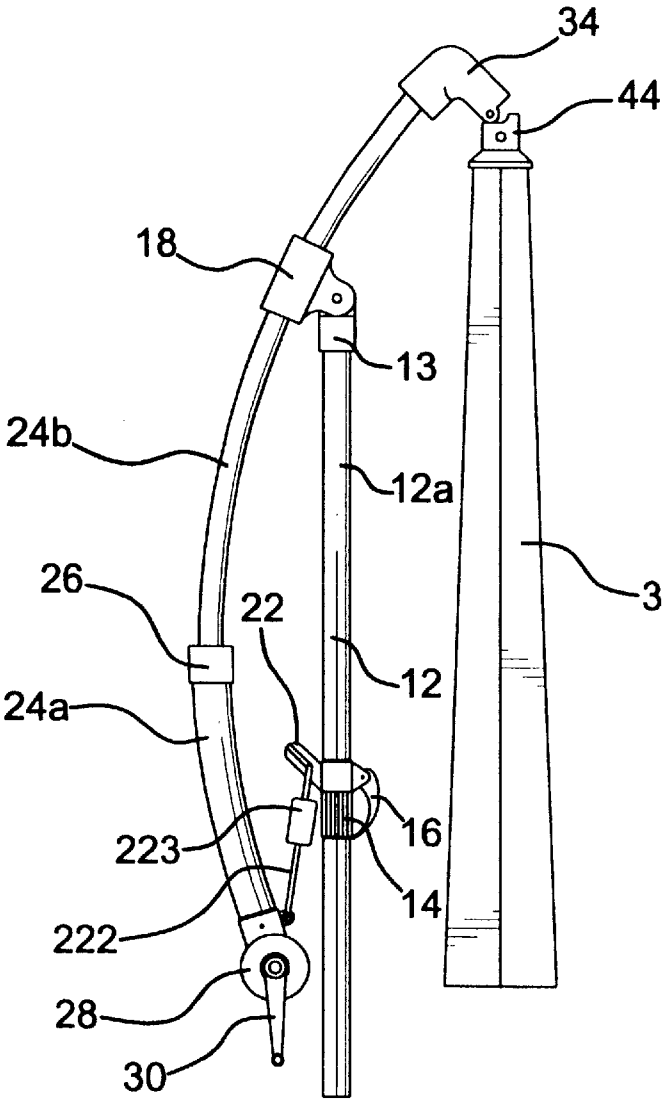
FIG. 10 is a side view similar to FIG. 9, wherein the sunshade is in a fully folded status.
Figure 11:
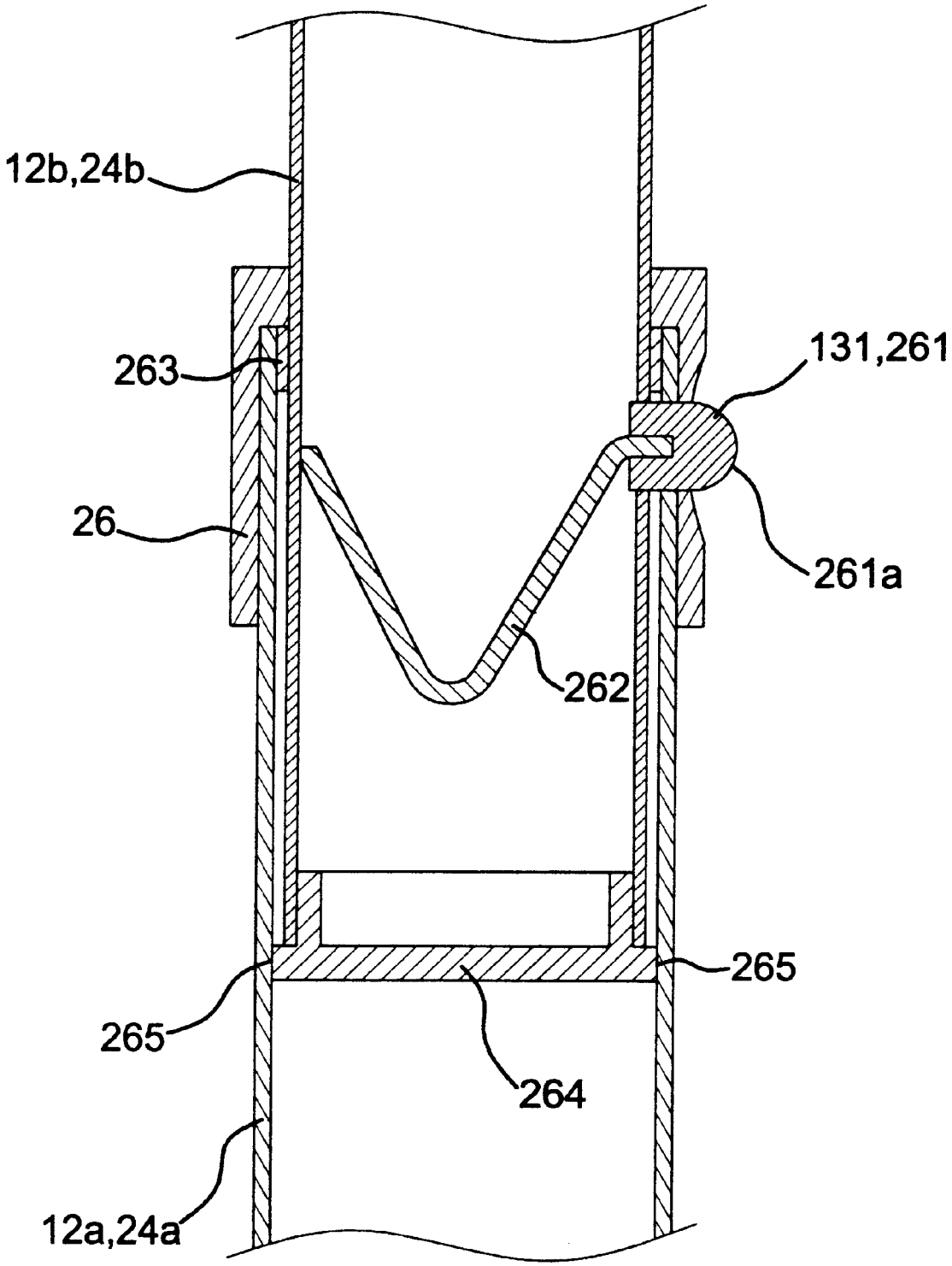
FIG. 11 is an enlarged partial sectional view of the arcuate tube.
Figure 12:
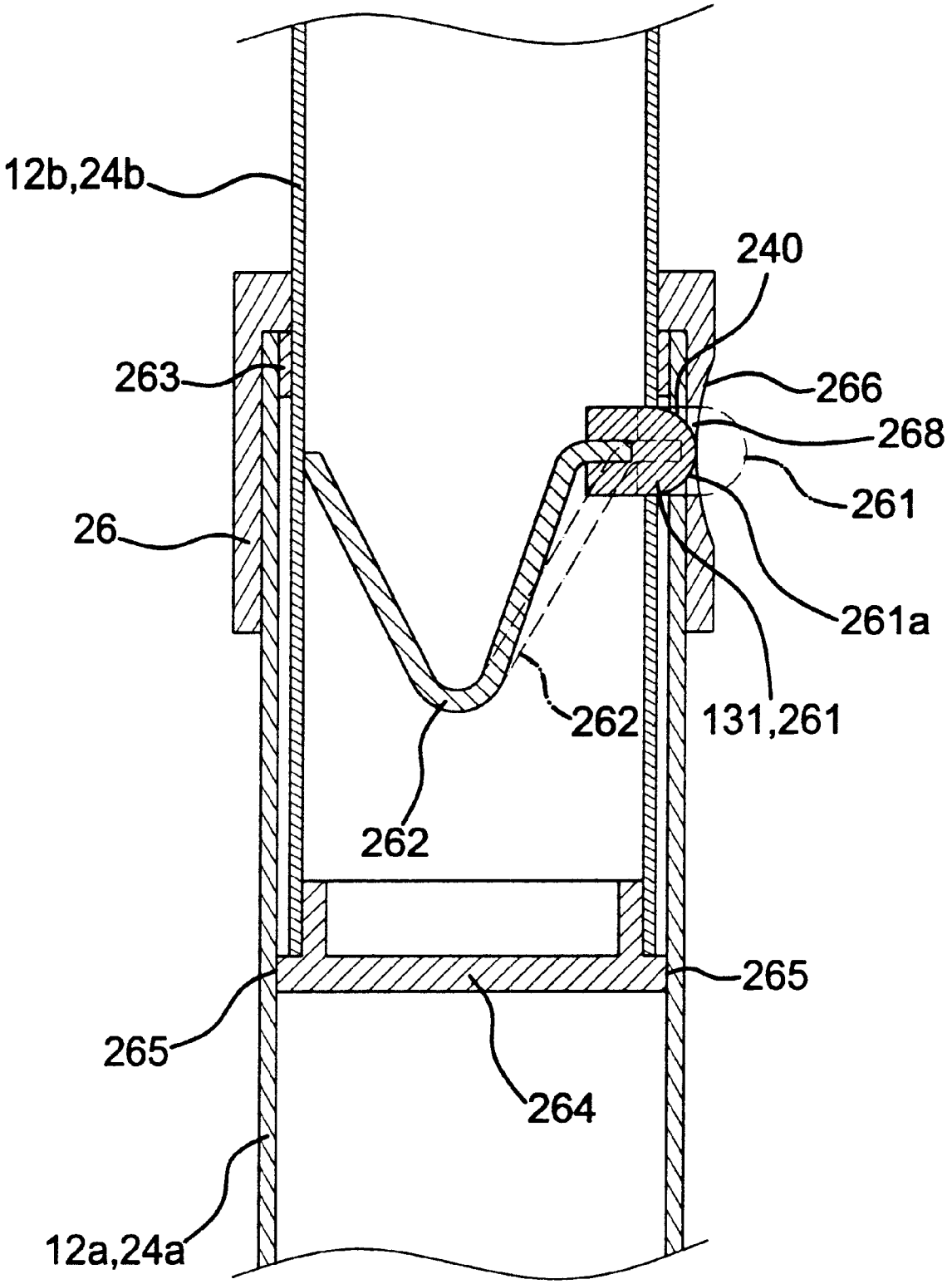
FIG. 12 is a view similar to FIG. 11, wherein a push button has been pushed inward.
Figure 13:
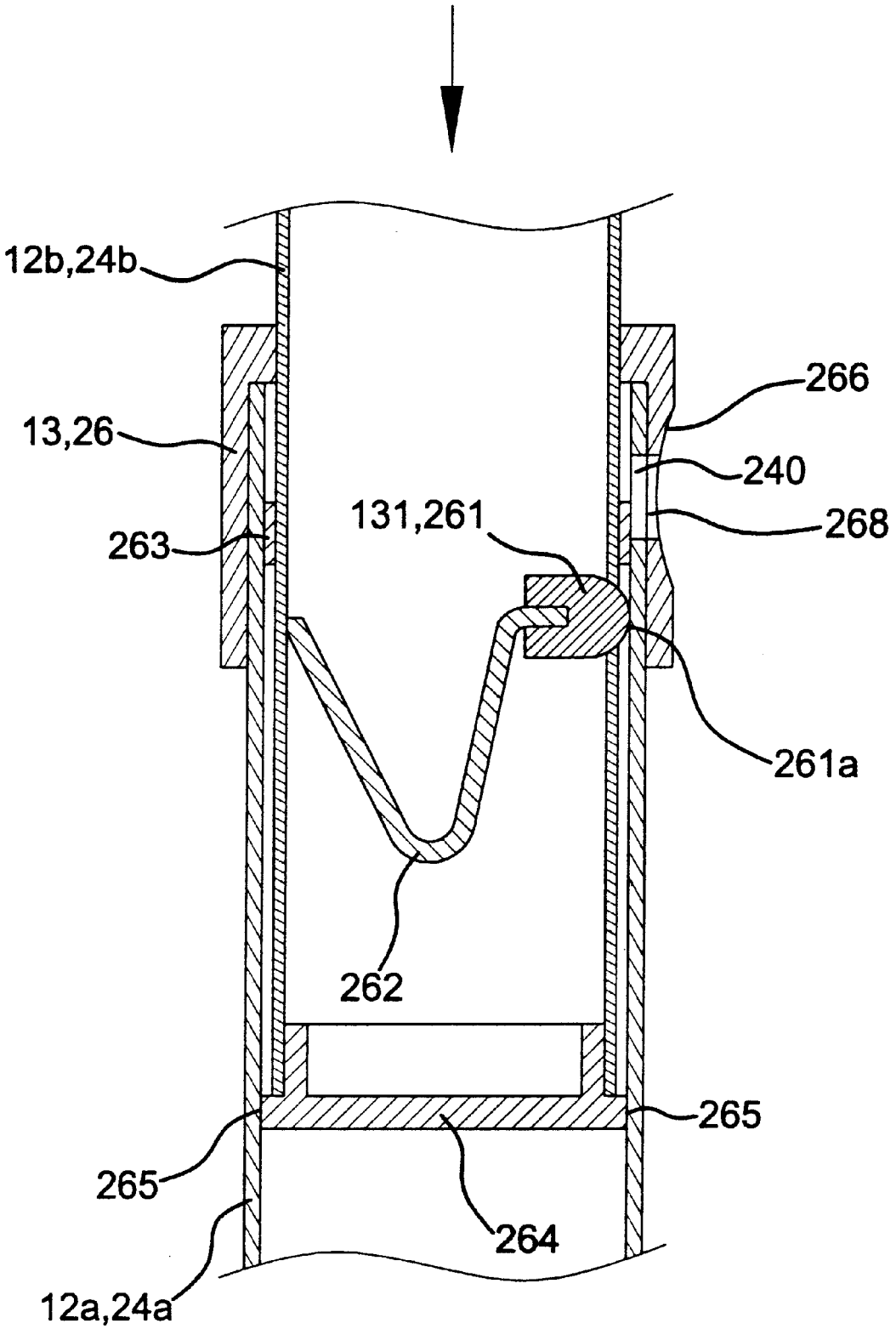
FIG. 13 is a view similar to FIG. 11, wherein an inner tube section of the arcuate tube is retracted into an outer tube section of the arcuate tube.

Turning to FIGS. 6 and 7, the adjusting sleeve 14 includes an extension 22 extended outwardly and upwardly and having at least one groove 221 (two grooves 221 in this embodiment). At least one connecting rod 222 (two rods in this embodiment) has a first end pivotally connected to the extension 22 and a second end pivotally connected to the end of the outer tube section 24*a*. A positioning sleeve 223 is slidably mounted to the connecting rods 222. When the positioning sleeve 223 is moved to a position that encloses the grooves 221 of the extension 22 of the adjusting sleeve 14, the arcuate tube 24 is supported, and the sunshade is in an unfolded status, best shown in FIG. 6. When not in use, the positioning sleeve 223 is moved away from the extension 22 of the adjusting sleeve 14, as shown in FIG. 7, such that the connecting rods 222 can be pivoted downwardly to leave the grooves 221 to a position shown in FIG. 8. The grooves 221 may have a dimension for holding a portion of the connecting rods 222 yet allow disengagement of the connecting rods 222 from the grooves 221 by means of forcibly pivoting the connecting rods 222 about the adjusting sleeve 14. It is appreciated that folding of the connecting rods 222 can be proceeded after the adjusting sleeve 14 is moved to its lowest position, best shown in FIG. 9. Thus, the sunshade can be folded and occupy a smaller space when not in use, which is convenient for storage and transport Referring to FIGS. 11–13, the sunshade can be further folded to further reduce the volume thereof in a manner as shown in FIG. 10. Referring to FIG. 13, the outer tube section 24*a* includes a transverse hole 240, and the control sleeve 26 includes a hole 268 aligned with the transverse hole 240. An elastic element 262 has a first end securely attached to an inner periphery of the inner tube section 24*b* and a second end to which a push button 261 is attached. An end cap 264 is securely attached to the end of the inner tube section 24*b* and includes a flange 265 in sliding contact with an inner periphery of the outer tube section 24*a*. In addition, a stop 263 is securely mounted around the inner tube section 24*b*. Turning to FIG. 11, when the arcuate tube 24 of the sunshade is in an extended status shown in FIG. 9, the push button 261 is extended through the transverse hole 240 of the outer tube section 24*a* and the hole 268 of the control sleeve 26; namely, the arcuate tube 24 is retained in its fully extended status by the push button 261. Referring to FIG. 12, when the push button 261 is pushed inward and a longitudinal force is applied to the inner tube section 24*b* (see the arrow in FIG. 13), a dome 261a of the push button 261 allows the push button 261 to be moved inward and thus disengaged from the transverse hole 240 of the outer tube section 24*a* and the hole 268 of the control sleeve 26. Thus, as illustrated in FIG. 13, the inner tube section 24*b* is retracted into the outer tube section 24*a*. Accordingly, the arcuate tube 24 can be folded to a status shown in FIG. 10. When the inner tube section 24*b* is pulled out of the outer tube section 24*a*, the push button 261 will be extended into the transverse hole 240 of the outer tube section 24*a* and the hole 268 of the control sleeve 26 under the action of the elastic element 262 when the push button 261 reaches the level of the transverse hole 240 of the outer tube section 24*a* and the hole 268 of the control sleeve 26. The stop 263 bears against an end face of the control sleeve 26 for preventing disengagement of the push button 261 when the arcuate tube 24 is in its fully extended status. The flange 265 of the end cap 264 provide a support for allowing stable sliding movement of the inner tube section 24*b* relative to the outer tube section 24*a*. The control sleeve 26 may include a concave surface 266 surrounding the hole 268 to allow deeper pressing action of the user's finger.

It is appreciated that the control sleeve 13 for the supporting rod 12 includes a structure identical to that of the control sleeve 26 shown in FIG. 11. Thus, when a push button 131 (identical to push button 261) is pushed, the upper tube section 12*b* can be retracted into the lower tube section 12*a* to a status shown in FIG. 10. Retraction and unfolding operation of the supporting rod 12 are identical to those of the arcuate tube 24 and thus will not be described in detail to avoid redundancy.

According to the above description, it is appreciated that the tilting angle of the canopy of the sunshade of the present invention can be easily adjusted, and the canopy is reliably retained in the desired tilting position after adjustment. In addition, the whole sunshade can be further collapsed after folding the canopy, which may reduce the cost for transport. Furthermore, the canopy support frame 2 together with the canopy 3 can be disengaged from the elbow 34 when not in use.

Although the invention has been explained in relation to its preferred embodiment, it is to be understood that many other possible modifications and variations can be made without departing from the spirit and scope of the invention as hereinafter claimed.

What is claimed is:

1. A sunshade comprising:

a supporting rod having a lower end and an upper end;

an adjusting sleeve slidably mounted around the supporting rod;

a holding sleeve pivotally connected to the upper end of the supporting rod;

an arcuate tube slidably extended through the holding sleeve and including a first end and a second end;

an elbow connected to the first end of the arcuate tube and including an anchor room;

an anchor releasably engaged in the anchor room;

a canopy support frame for supporting a canopy and including a suspension member connected to the elbow, an upper support base having a plurality of ribs attached thereto for supporting a canopy, and a lower support base having a plurality of stretchers attached thereto for supporting the ribs, the lower support base being connected to the anchor;

a reel mounted to the second end of the arcuate tube and including a handle;

a cable having a first end connected to the handle and a second end connected to the anchor, the cable being movable in a retracting direction and a releasing direction;

a connecting rod connected between the second end of the arcuate tube and the adjusting sleeve;

wherein when the handle is operated to release the cable in the releasing direction, the anchor is disengaged from the anchor room of the elbow while the canopy is folded, and when the handle is operated to retract the cable in the retracting direction, the anchor is moved into the anchor room and thus engages the suspension member with the elbow when the canopy is in a fully opened status;

wherein the adjusting sleeve is slidable along the supporting rod while the arcuate tube is slidable along the holding sleeve to adjust a tilting angle of the canopy relative to the supporting rod; and wherein the arcuate tube includes at least two telescopic tube sections to allow adjustment of an overall length of the arcuate tube.

2. The sunshade as claimed in claim 1, wherein the arcuate tube includes a control sleeve to restrain sliding movement of the arcuate tube relative to the holding sleeve.

3. The sunshade as claimed in claim 2, wherein the control sleeve bears against the holding sleeve when the canopy is in an upright position.

4. The sunshade as claimed in claim 3, wherein the arcuate tube includes:

an outer tube section having a first end to which the reel is attached and a second end, the outer tube section including a transverse hole; and an inner tube section having a first end telescopically received in the second end of the outer tube section and a second end to which the elbow is attached;

the control sleeve being mounted to the second end of the outer tube section and including a hole aligned with the transverse hole of the outer tube section;

further comprising:

an elastic element having a first end securely attached to an inner periphery of the inner tube section and a second end to which a push button is attached;

wherein when the arcuate tube is in an extended status, the push button is extended through the transverse hole of the outer tube section and the hole of the control sleeve;

wherein when the push button is pushed inward and a longitudinal force is applied to the inner tube section in a retracting direction, the inner tube section is retracted into the outer tube section.

5. The sunshade as claimed in claim 4, wherein when a longitudinal force is applied to the inner tube section in a releasing direction, the inner tube section is pulled out of the outer tube section and the push button is extended into the transverse hole of the outer tube section and the hole of the control sleeve under the action of the elastic element when the push button reaches the level of the transverse hole of the outer tube section and the hole of the control sleeve.

6. The sunshade as claimed in claim 5, wherein the push button includes a dome.

7. The sunshade as claimed in claim 4, wherein the first end of the inner tube section includes an end cap securely attached thereto, the end cap including a flange in sliding contact with an inner periphery of the outer tube section.

8. The sunshade as claimed in claim 4, further comprising a stop securely mounted around the inner tube section, wherein the stop bears against an end face of the control sleeve for preventing disengagement of the push button when the arcuate tube is in its fully extended status.

9. The sunshade as claimed in claim 7, further comprising a stop securely mounted around the inner tube section, wherein the stop bears against an end face of the control sleeve for preventing disengagement of the push button when the arcuate tube is in its fully extended status.

10. The sunshade as claimed in claim 9, wherein the stop and the flange assure stable sliding movement of the inner tube section relative to the outer tube section.

11. The sunshade as claimed in claim 1, wherein the adjusting sleeve includes an extension extended outwardly and upwardly and having a groove defined therein, the connecting rod includes a first end pivotally connected to the extension and a second end pivotally connected to the second end of the arcuate tube, a portion of the connecting rod being releasably received in the groove, and a positioning sleeve being slidably mounted to the connecting rod and movable between a first position covering the groove of the extension to retain the connecting rod in place and a second position disengaged from the extension to allow pivotal movement of the connecting rod relative to the extension.

12. The sunshade as claimed in claim 1, wherein the suspension member includes a transverse hole defined in a periphery thereof, and the upper support base includes a tube having a button mounted to an upper end thereof and biased outwardly by an elastic member, the button being releasably extended through the transverse hole of the suspension member to releasably connect the suspension member with the upper support base.

13. A sunshade comprising:

a supporting rod having a lower end and an upper end;

an adjusting sleeve slidably mounted around the supporting rod;

a holding sleeve pivotally connected to the upper end of the supporting rod;

an arcuate tube slidably extended through the holding sleeve and including a first end and a second end;

an elbow connected to the first end of the arcuate tube and including an anchor room;

an anchor releasably engaged in the anchor room;

a canopy support frame for supporting a canopy and including a suspension member connected to the elbow, an upper support base having a plurality of ribs attached thereto for supporting a canopy, and a lower support base having a plurality of stretchers attached thereto for supporting the ribs, the lower support base being connected to the anchor;

a reel mounted to the second end of the arcuate tube and including a handle;

a cable having a first end connected to the handle and a second end connected to the anchor, the cable being movable in a retracting direction and a releasing direction;

a connecting rod connected between the second end of the arcuate tube and the adjusting sleeve;

wherein when the handle is operated to release the cable in the releasing direction, the anchor is disengaged from the anchor room of the elbow while the canopy is folded, and when the handle is operated to retract the cable in the retracting direction, the anchor is moved into the anchor room and thus engages the suspension member with the elbow when the canopy is in a fully opened status;

wherein the adjusting sleeve is slidable along the supporting rod while the arcuate tube is slidable along the holding sleeve to adjust a tilting angle of the canopy relative to the supporting rod;

wherein the supporting rod includes:

a lower tube section to which the adjusting sleeve is mounted, the lower tube section including a transverse hole; and an upper tube section having a lower end telescopically received in the lower tube section and a second end to which the holding sleeve is attached;

a control sleeve mounted to the upper end of the lower tube section, the control sleeve including a hole aligned with the transverse hole of the lower tube section; and an elastic element having a first end securely attached to an inner periphery of the upper tube section and a second end to which a push button is attached;

wherein when the supporting rod is in an extended status, the push button is extended through the transverse hole of the lower tube section and the hole of the control sleeve;

wherein when the push button is pushed inward and a longitudinal force is applied to the upper tube section in a retracting direction, the upper tube section is retracted into the lower tube section; and wherein the lower and upper tube sections allow adjustment of an overall length of the support rod.

14. The sunshade as claimed in claim 13, wherein when a longitudinal force is applied to the upper tube section in a releasing direction, the upper tube section is pulled out of the lower tube section and the push button is extended into the transverse hole of the lower tube section and the hole of the control sleeve under the action of the elastic element when the push button reaches the level of the transverse hole of the lower tube section and the hole of the control sleeve.

15. The sunshade as claimed in claim 14, wherein the push button includes a dome.

16. The sunshade as claimed in claim 13, wherein the first end of the upper tube section includes an end cap securely attached thereto, the end cap including a flange in sliding contact with an inner periphery of the lower tube section.

17. The sunshade as claimed in claim 13, further comprising a stop securely mounted around the upper tube section, wherein the stop bears against an end face of the control sleeve for preventing disengagement of the push button when the supporting rod is in its fully extended status.

18. The sunshade as claimed in claim 16, further comprising a stop securely mounted around the upper tube section, wherein the stop bears against an end face of the control sleeve for preventing disengagement of the push button when the supporting rod is in its fully extended status.

19. The sunshade as claimed in claim 18, wherein the stop and the flange assure stable sliding movement of the upper tube section relative to the lower tube section.

20. The sunshade as claimed in claim 13, wherein the arcuate tube includes at least two telescopic tube sections to allow adjustment of an overall length of the arcuate tube.

* * * * *